US009966681B2

(12) United States Patent
Kurachi

(10) Patent No.: US 9,966,681 B2
(45) Date of Patent: May 8, 2018

(54) ELECTRICAL CONNECTOR TO SHEILD A TRANSMISSION PATH

(71) Applicant: DAI-ICHI SEIKO CO., LTD., Kyoto-shi (JP)

(72) Inventor: Takaki Kurachi, Fukuoka (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days. days.

(21) Appl. No.: 14/670,664

(22) Filed: Mar. 27, 2015

(65) Prior Publication Data

US 2015/0311640 A1 Oct. 29, 2015

(30) Foreign Application Priority Data

Apr. 28, 2014 (JP) ..... 2014-093102

(51) Int. Cl.
*H01R 12/88* (2011.01)
*H01R 13/62* (2006.01)
(Continued)

(52) U.S. Cl.
CPC ..... *H01R 12/775* (2013.01); *H01R 12/88* (2013.01); *H01R 12/89* (2013.01)

(58) Field of Classification Search
CPC .. H01R 13/502; H01R 13/6581; H01R 12/88; H01R 12/89; H01R 12/721; H01R 12/775; H01R 13/62
(Continued)

(56) References Cited

U.S. PATENT DOCUMENTS 5,738,545 A * 4/1998 Igarashi ..... H01R 12/778 439/492
6,066,000 A * 5/2000 Masumoto ..... H01R 13/6593 439/497
(Continued)

FOREIGN PATENT DOCUMENTS

JP 2000-106237 A 4/2000
JP 2004-63401 A 2/2004
(Continued)

OTHER PUBLICATIONS

Extended Search Report dated Sep. 28, 2015 in European Patent Application No. 15164753.4.
(Continued)

*Primary Examiner* — Michael A Lyons
*Assistant Examiner* — Milagros Jeancharles
(74) *Attorney, Agent, or Firm* — Oblon, McClelland, Maier & Neustadt, L.L.P.

(57) ABSTRACT

While efficient assembly performance of an electrical connector is obtained, good operability can be also obtained by a simple configuration. Good shielding performance with respect to transmission paths are configured to be obtained by a simple configuration in which movement of an actuator causes both shield shells to contact each other by covering at least part of outer surfaces of an insulating housing and the actuator by the shield shells consisting of electrically-conductive metal members, causing the actuator-side shield shell moved to an action position to contact the insulating-housing-side shield shell, and continuously covering the transmission paths, which are from a signal transmission medium to a printed wiring board through electrically-conductive contact members.

6 Claims, 16 Drawing Sheets

(51) Int. Cl.
*H01R 12/77* (2011.01)
*H01R 12/89* (2011.01)

(58) Field of Classification Search
USPC ..... 439/607.31, 607.35, 607.36, 153, 497, 439/353, 626, 55, 325, 329, 495
See application file for complete search history.

(56) References Cited

U.S. PATENT DOCUMENTS

| | | | | |
|---|---|---|---|---|
| 6,821,158 | B2 * | 11/2004 | Iida | H01R 12/79 439/492 |
| 7,828,571 | B2 * | 11/2010 | Satoh | H01R 12/88 439/260 |
| 8,025,516 | B2 * | 9/2011 | Yokoo | H01R 12/88 439/260 |
| 8,083,542 | B2 * | 12/2011 | Kodaira | H01R 12/594 439/497 |
| 8,622,766 | B2 * | 1/2014 | Yokoo | H01R 12/775 439/260 |
| 9,065,227 | B2 * | 6/2015 | Ashibu | H01R 12/79 |
| 9,153,888 | B2 * | 10/2015 | Kajiura | H01R 12/72 |
| 9,184,531 | B2 * | 11/2015 | Chen | H01R 13/518 |
| 9,647,365 | B2 * | 5/2017 | Ogino | H01R 12/771 |
| 2002/0115340 | A1 * | 8/2002 | Yamane | H01R 23/661 439/495 |
| 2008/0188115 | A1 | 8/2008 | Watanabe | |
| 2010/0255705 | A1 * | 10/2010 | Higuchi | H01R 12/79 439/329 |
| 2011/0151682 | A1 | 6/2011 | Kodaira | |
| 2011/0318963 | A1 | 12/2011 | Kamoya et al. | |
| 2013/0137284 | A1 | 5/2013 | Shindo et al. | |

FOREIGN PATENT DOCUMENTS

| | | | |
|---|---|---|---|
| JP | 2005-268018 | A | 9/2005 |
| JP | 2006-32243 | A | 2/2006 |
| JP | 2008-27707 | A | 2/2008 |
| JP | 2009-206097 | A | 9/2009 |
| JP | 2009-272256 | A | 11/2009 |
| JP | 2010-205576 | A | 9/2010 |
| JP | 2011-034902 | A | 2/2011 |
| JP | 2012-59434 | | 3/2012 |
| JP | 2014-11032 | | 1/2014 |

OTHER PUBLICATIONS

Korean Office Action dated Mar. 16, 2016 in Patent Application No. 10-2015-0045974.

Japanese Office Action dated Dec. 22, 2015 in Patent Application No. 2014-093102 (without EnglishTranslation).

* cited by examiner

ELECTRICAL CONNECTOR TO SHEILD A TRANSMISSION PATH

BACKGROUND OF THE INVENTION

Field of the Invention

The present invention relates to an electrical connector configured to establish an electrical connection(s) by inserting a signal transmission medium into an insulating housing.

Description of Related Art

Generally, it is widely carried out to mount an electrical connector on a printed wiring board used in various electrical devices, etc. and electrically connect a signal transmission medium of various types such as a flexible printed circuit (FPC), a flexible flat cable (FFC), or the like to the printed wiring board via the electrical connector. For example, in an electrical connector described in below-described Patent Document, electrical connections are configured to be established by inserting a signal transmission medium consisting of, for example, a FPC or FFC from an insertion opening of the electrical connector mounted on a printed wiring board into a medium housing passage, subjecting an actuator (connection operating means) to a turning operation or a sliding operation to elastically displace electrically-conductive contact members after the insertion of the signal transmission medium (for example, FPC or FFC) is completed, and bringing contact parts of the electrically-contact members into pressure-contact with electrode parts of the signal transmission medium.

On the other hand, when the frequencies of transmission signals are increased like those of recent years, an electromagnetic-wave shutoff (EMI) measure of shielding the transmission paths from the signal transmission medium to the electrically-conductive contact members are required. However, in an electrical connector provided with an actuator, the actuator is turned or slid; therefore, a spatial part is formed between the insulating housing and the actuator, and there is a problem that a sufficient electromagnetic-wave shut-off function cannot be easily obtained. Against such a problem, for example, Japanese Patent Application Laid-Open No. 2014-11032 proposes a configuration in which the shield shell, which opens/closes the upper surface of the insulating housing, is turnably provided, the shield shell is subjected to a turning operation after the actuator is subjected to a turning operation, thereby covering both of the insulating housing and the actuator from the upper side by the shield shells.

However, in such a conventional electrical connector, although a predetermined action of electromagnetic-wave shut-off is obtained, there are problems that the configuration is complex and that the turning operations of both of the members takes labor since the mechanism of turnably supporting both of the actuator and the shield shells is employed. Moreover, for example if the electrical connector is suctioned from the upper side, for example, in an assembly process of the electrical connector, there is a problem that the shield shell covering the upper surface of the insulating housing is disturbing, and efficient assembly performance cannot be easily obtained.

The inventor of the present invention submits herewith a publication of (unexamined) patent applications "JP 2014-11032 A" as prior art.

BRIEF SUMMARY OF THE INVENTION

Therefore, it is an object of the present invention to provide an electrical connector capable of well shielding a transmission path from a signal transmission medium to an electrically-conductive contact member and obtaining good operability while obtaining efficient assembly performance by a simple configuration.

In order to achieve the above described object, in the present invention, an electrical connector wherein an actuator is reciprocably attached to an insulating housing having an interior in which an electrically-conductive contact member is disposed, the electrical connector configured so as to form a transmission path from a signal transmission medium to a printed wiring board through the electrically-conductive contact member by moving the actuator from an initial position to an action position and electrically connecting the signal transmission medium inserted in the insulating housing with the electrically-conductive contact member; wherein shield shells consisting of electrically-conductive metal members are respectively attached to the insulating housing and the actuator so as to cover at least part of outer surfaces of the insulating housing and the actuator; there is a disposition relation that, when the actuator is moved to the action position, the actuator-side shield shell and the insulating-housing-side shield shell contact each other so as to continuously cover the transmission path from the signal transmission medium to the printed wiring board through the electrically-conductive contact member.

According to the present invention having such a configuration, by virtue of the simple configuration in which the actuator-side shield shell and the insulating-housing-side shield shell contact each other when the actuator is moved to the action position, the transmission path from the signal transmission medium to the printed wiring board through the electrically-conductive member is continuously covered, and good shielding performance is obtained.

Moreover, in the present invention, the actuator is configured to be turned from the initial position, at which the actuator is raised from an upper surface of the insulating housing, to a tilted-down position, at which the actuator is extending along the upper surface of the insulating housing.

Moreover, in the present invention, the actuator can be configured so that the actuator is slid from the initial position, at which the actuator is separated from the insulating housing in the direction along the printed wiring board, to the action position, at which the actuator is in contact with the insulating housing.

Moreover, in the present invention, both of the shield shells covering the insulating housing and the actuator are configured to be partially overlapped with each other in a state of the actuator moved to the action position.

According to the present invention having such a configuration, the actuator-side shield shell and the insulating-housing-side shield shell contact each other without a gap, and the electromagnetic-wave shut-off action by the shield shells is further improved.

A ground member in contact with the shield shell covering the actuator in a state of the actuator moved to the action position is elastically deformably provided on the shield shell covering the insulating housing of the present invention.

Moreover, a ground member in contact with the signal transmission medium inserted in the insulating housing is elastically deformably provided on the shield shell covering the insulating housing of the present invention.

Moreover, it is desired that a ground member in contact with the shield shell covering the insulating housing in a state of the actuator moved to the action position be elastically deformably provided on the shield shell covering the actuator of the present invention.

According to the present invention having such a configuration, ground characteristics are configured to be improved by reducing ground resistance.

Moreover, it is desired that a ground member in contact with the electrically-conductive contact member be elastically deformably provided on the shield shell covering the insulating housing of the present invention.

According to the present invention having such a configuration, the electrical paths constituting a ground circuit are in a multi-point contact state, and the ground resistance is reduced.

As described above, in an electrical connector according to the present invention, good shielding performance with respect to transmission paths are configured to be obtained by a simple configuration in which movement of an actuator causes both shield shells to contact each other by covering at least part of outer surfaces of an insulating housing and the actuator by the shield shells consisting of electrically-conductive metal members, causing the actuator-side shield shell moved to an action position to contact the insulating-housing-side shield shell, and continuously covering the transmission paths, which are from a signal transmission medium to a printed wiring board through electrically-conductive contact members. Therefore, while efficient assembly performance is obtained, good operability can be also obtained, and reliability of the electrical connector can be significantly improved inexpensively.

DETAILED DESCRIPTION OF THE INVENTION

Figure 1:
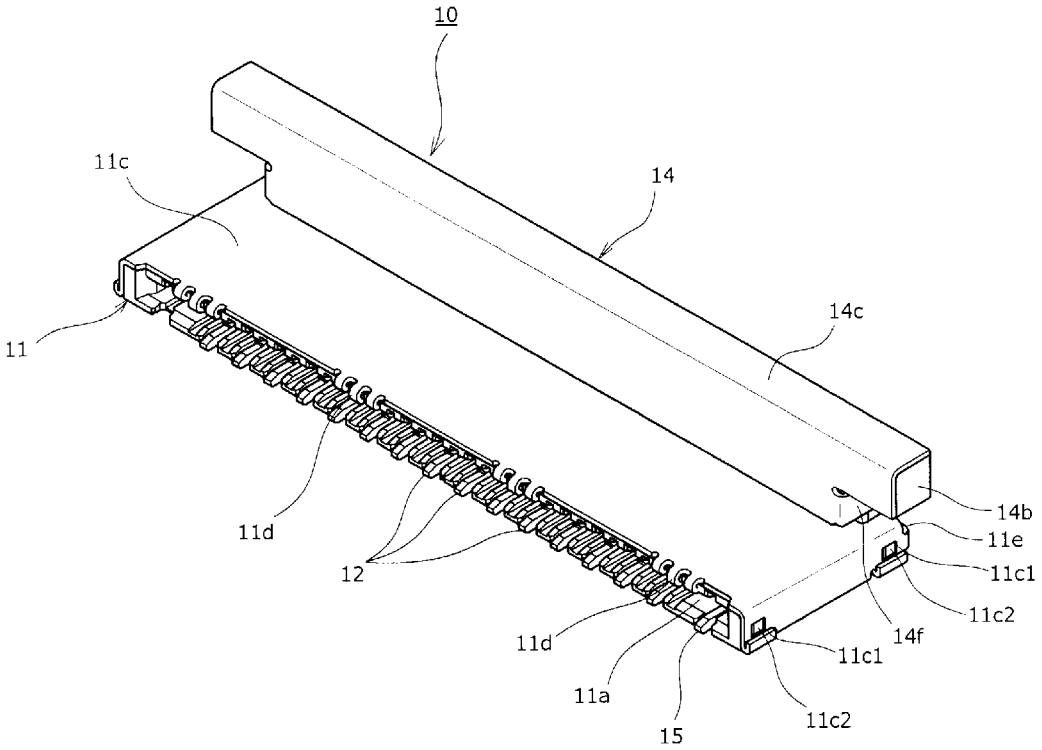
FIG. 1 is an external-perspective-view explanatory drawing showing, from the upper side of a connector front side, a state in which an actuator is raised to an initial position in an electrical connector according to a first embodiment of the present invention.
Figure 2:
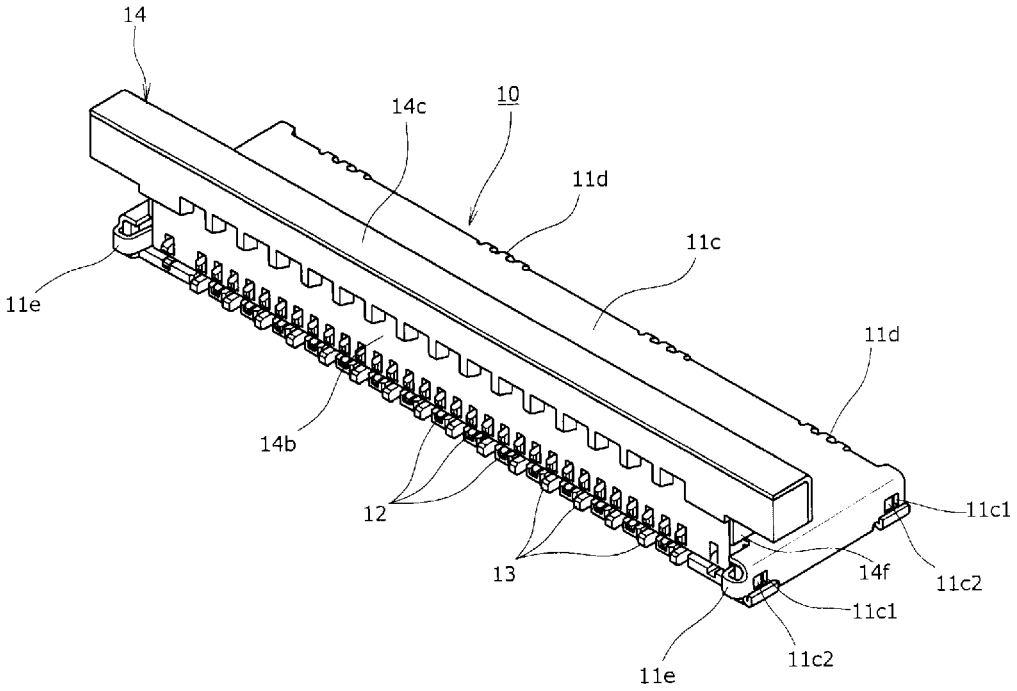
FIG. 2 is an external-perspective-view explanatory drawing showing the electrical connector, which is shown in FIG. 1, from the upper side of a connector back-surface side.
Figure 3:
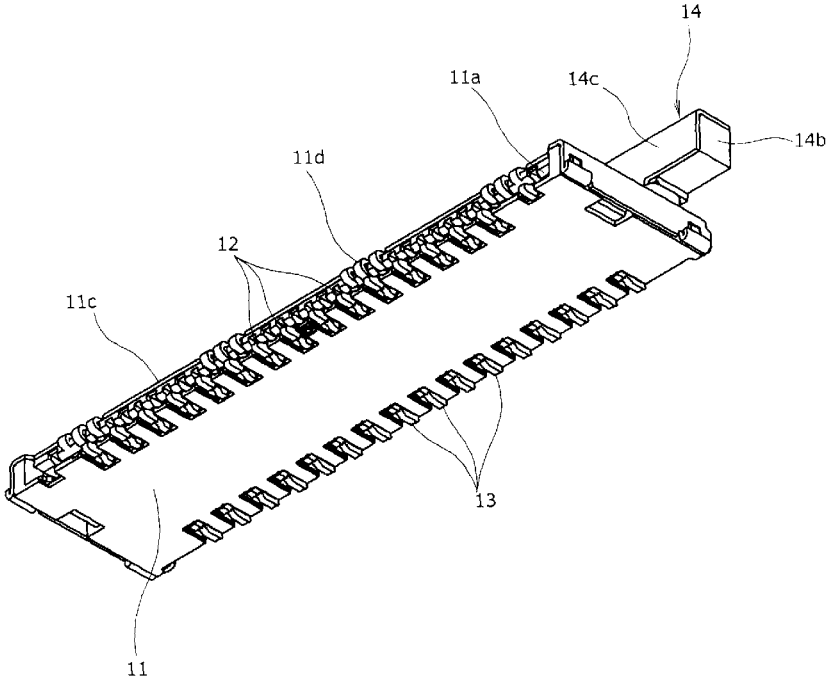
FIG. 3 is an external-perspective-view explanatory drawing showing the electrical connector, which is shown in FIG. 1 and FIG. 2, from the lower side of the connector front side.
Figure 4:
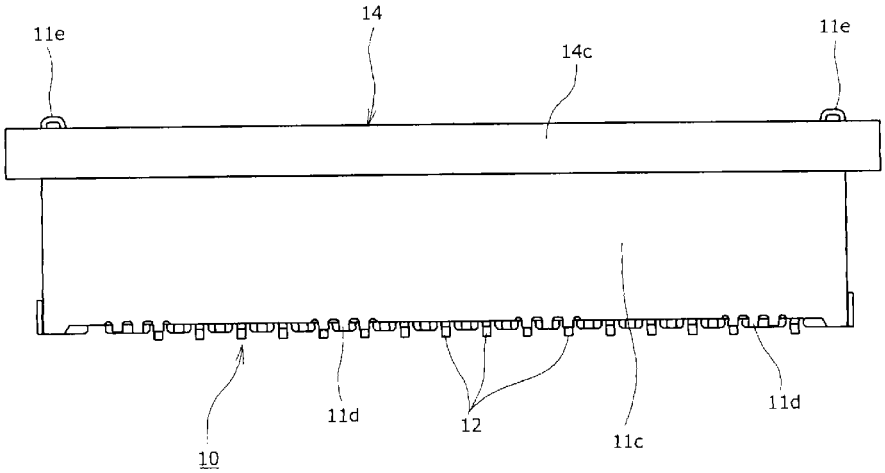
FIG. 4 is a plan explanatory drawing of the electrical connector, which is shown in FIG. 1 to FIG. 3.
Figure 5:
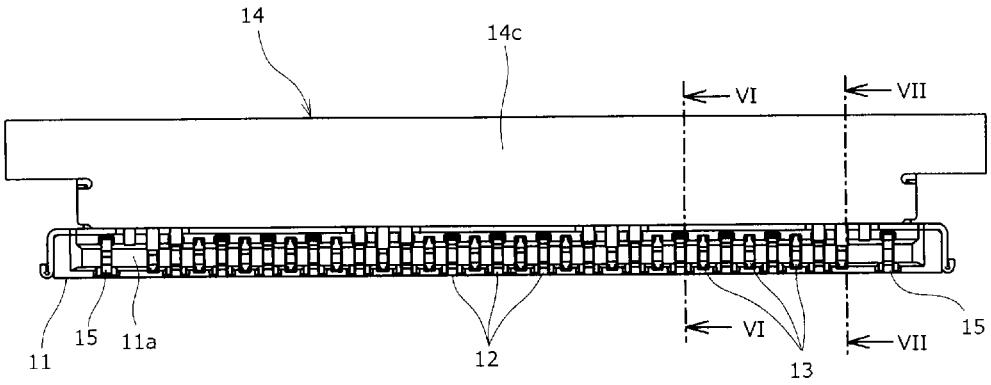
FIG. 5 is a front explanatory drawing of the electrical connector, which is shown in FIG. 1 to FIG. 4.

Hereinafter, an embodiment of the present invention will be explained in detail based on drawings.

[About Connector Overall Structure]

First, an electrical connector 10 according to the embodiment of the present invention shown in FIG. 1 to FIG. 7 consists of a receptacle connector used by being mounted on an illustration-omitted printed wiring board and is provided with an insulating housing (insulator) 11, which consists of a slenderly-extending insulating member. The insulating housing 11 is formed of a thin hollow chassis, which forms an approximately rectangular shape in a plane. A first side (left end side in FIG. 6 and FIG. 7) of long-side both edges of the insulating housing 11, which are opposed to each other, in other words, a connector front edge part is provided with a front-side insertion opening 11*a* into which a signal transmission medium F (see FIG. 17) consisting of a flexible printed circuit (FPC), a flexible flat cable (FFC), or the like is to be inserted so that the front-side insertion opening 11*a* has a transverse slender shape.

Moreover, a second-end edge in the opposite side (right end side of FIG. 6 and FIG. 7) of the front-side insertion opening 11*a*, in other words, a connector rear-edge part is provided with a rear-side opening for attaching later-described electrically-conductive contacts 12 and 13 and an actuator 14, which serves as a connection operating means. In an intermediate part from the above described front-side insertion opening 11*a* to the rear-side opening, a medium housing passage 11*b*, which houses the signal transmission medium (for example, FPC or FFC) F when the signal transmission medium F is inserted.

Hereinafter, the direction corresponding to the longitudinal direction of the above described insulating housing 11 will be referred to as a "connector longitudinal direction", the direction in which the front-side insertion opening 11*a* and the rear-side opening are opposed to each other will be referred to as a "connector front-rear direction", and the direction orthogonal to both of the "connector longitudinal direction" and the "connector front-rear direction" will be referred to as a "connector top-bottom direction".

On the other hand, a housing shell (shield shell) 11*c*, which consists of an electrically-conductive plate-shaped metal member covering the outer surface of the insulating housing 11, is attached to the above described insulating housing 11. This housing shell 11*c* is attached to the part from an upper-surface part of the outer surface of the insulating housing 11 to connector-longitudinal-direction both lateral wall surfaces and is in a disposed state so as to cover the parts excluding the above described front-side insertion opening 11*a*, the rear-side opening, and a bottom-surface part; and the entire housing shell 11*c* is configured to be fixed when a plurality of fixing holes 11*c*1 formed to penetrate through lateral-wall plates at connector-longitudinal-direction both ends of the housing shell 11*c* are engaged with fixing projections 11*c*2 provided to project from the outer surface of the insulating housing 11 in this state.

At the connector front edge part of the housing shell (shield shell) 11*c* like this, a plurality of front-end ground contact pieces (ground members) 11*d* consisting of spring-shaped members, which elastically contact an upper-side surface of the signal transmission medium (for example, FPC or FFC) F, are provided along the connector longitudinal direction. Each of these front-end ground contact pieces 11*d* is formed so as to be bent toward the inner side of the front-side insertion opening 11*a* and is formed so as to be further bent back from the inner side of the front-side insertion opening 11*a* toward the connector rear side.

Furthermore, the connector-longitudinal-direction both side parts of the above described housing shell (shield shell) 11*c* have lateral wall parts, which are disposed so as to be raised from the illustration-omitted printed wiring board. Lateral-end ground contact pieces (ground members) 11*e*, 11*e*, which consist of spring-shaped members bulging toward the connector inner side (connector center side), are integrally formed with the rear end parts of the lateral wall parts. Each of the lateral-end ground contact pieces 11*e* is extending so as to be bent back toward the connector rear side and is configured so as to electrically contact part of a later-described actuator shell 14*c*.

[About Electrically-Conductive Contacts]

Moreover, the plurality of electrically-conductive contacts (contact members) 12 and 13 each having a lateral-plane shape which is an approximately H shape transversely turned over at a right angle are inserted in the medium housing passage 11*b* provided in the insulating housing 11 so as to extend in the connector front-rear direction. The electrically-conductive contacts 12 and 13 are formed of thin-plate-shaped metal members and are disposed so as to be juxtaposed to form multipolar shapes in attachment grooves, which are provided to be recessed at appropriate intervals in the width direction (connector longitudinal direction) of the insulating housing 11. These electrically-conductive contacts 12 and 13 are configured to have a so-called zigzag arrangement, in which mutually different shapes are alternately disposed. As described later, front-end parts (left-end parts in FIG. 6) of the electrically-conductive contacts 12 of a first side are solder-joined on the printed wiring board (illustration omitted), and rear-end parts (right-end parts in FIG. 6) of the electrically-conductive contacts 13 of a second side are solder-joined on the printed wiring board so that they can be used for signal transmission or shielding.

The electrically-conductive contacts 12 and 13 are attached as described above so as to be pushed in from the front side and the rear side of the connector toward the rear side (right side in FIG. 6) and the front side (left side in FIG. 7) of the connector, respectively. The electrically-conductive contacts 12 and 13 are respectively disposed at the positions corresponding to electrically conductive paths consisting of signal-transmission electrically-conductive paths (signal lines) or shielding electrically-conductive paths (shield line) formed on a front surface or a back surface of the signal transmission medium (for example, FPC or FFC). These electrically-conductive contacts 12 and 13 correspondingly have movable contact beams 12*a* and 13*a* and fixed contact beams 12*b* and 13*b* consisting of pairs of slender beam members extending along the inserting/removing direction (left/right direction in FIG. 6 and FIG. 7) of the signal transmission medium F.

Figure 6:
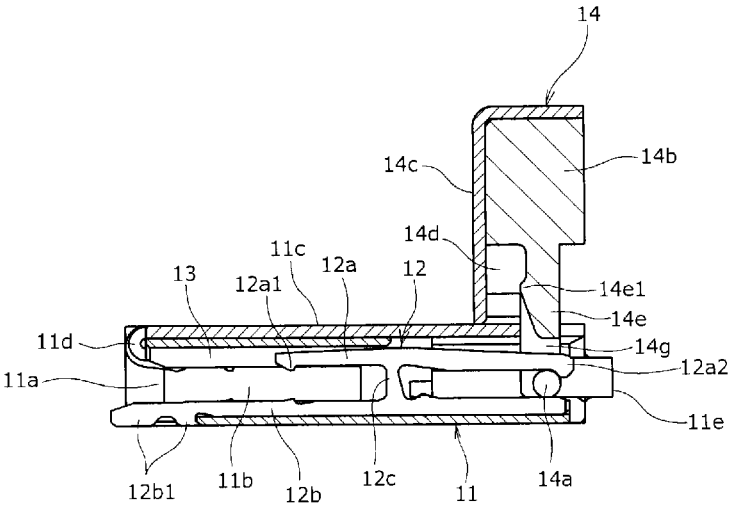
FIG. 6 is a transverse cross-sectional explanatory drawing taken along a line VI-VI in FIG. 5.
Figure 7:
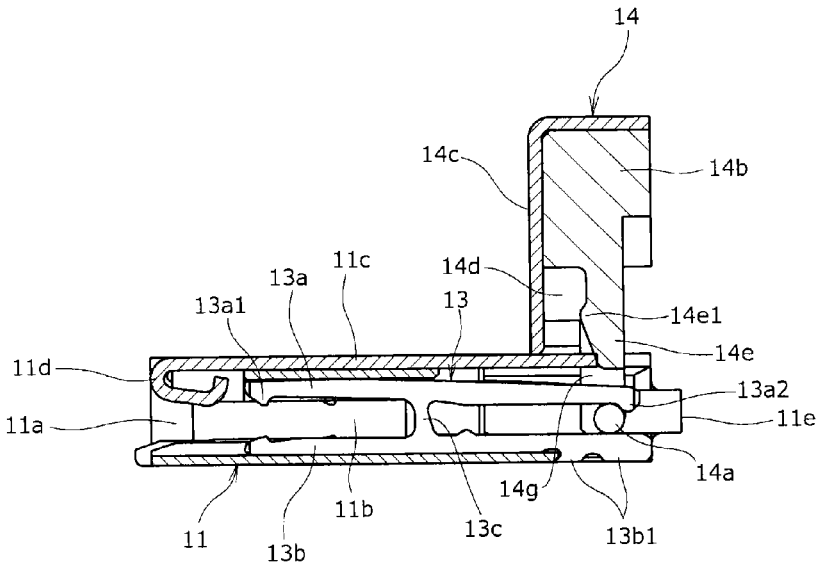
FIG. 7 is a transverse cross-sectional explanatory drawing taken along a line VII-VII in FIG. 5.
Figure 8:
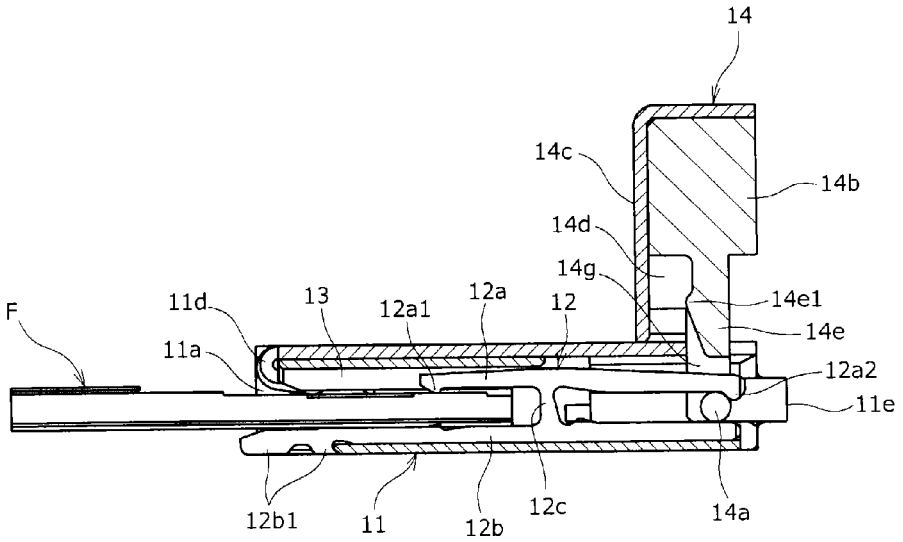
FIG. 8 is a FIG. 6 corresponding transverse cross-sectional explanatory drawing and showing a state in which a terminal part of a signal transmission medium (for example, FPC or FFC) is inserted in the electrical connector at an "initial position" shown in FIG. 1 to FIG. 7.
Figure 9:
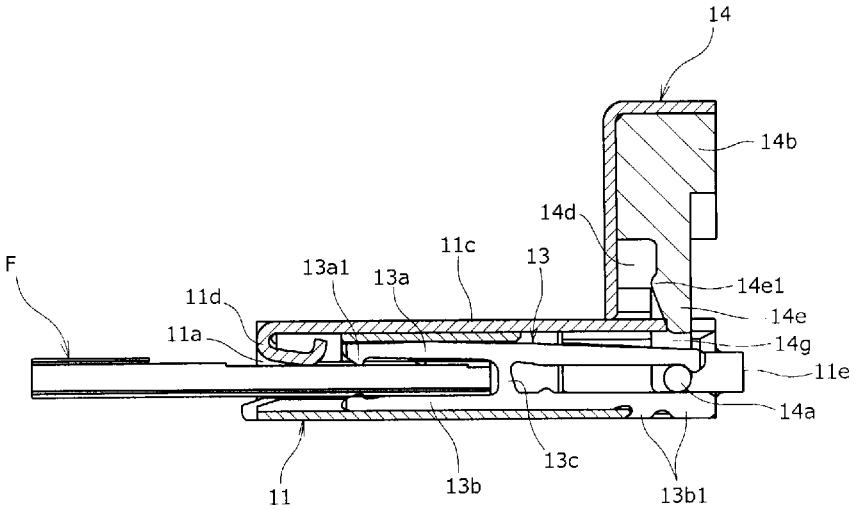
FIG. 9 is a FIG. 7 corresponding transverse cross-sectional explanatory drawing showing a state in which the terminal part of the signal transmission medium (for example, FPC or FFC) is inserted in the electrical connector in the "initial position" shown in FIG. 1 to FIG. 7.

These movable contact beams 12*a* and 13*a* and the fixed contact beams 12*b* and 13*b* are disposed in a state in which the beams are opposed to each other with appropriate intervals therebetween in the connector top-bottom direction in the inner-side space of the medium housing passage 11*b* provided in the above described insulating housing 11, and the beams are extending so as to form slender shapes along the connector front-rear direction (left-right direction in FIG. 6 and FIG. 7). Among them, the fixed contact beams 12*b* and 13*b* are disposed so as to extend along the bottom-part inner-wall surface of the insulating housing 11 and are retained so as to be in an approximately immobile state in the insulating housing 11.

Narrow-plate-shaped coupling pillar parts 12*c* and 13*c* extending in an approximately perpendicular direction (top-bottom direction in FIG. 6 and FIG. 7) are integrally coupled with the fixed contact beams 12*b* and 13*b*, respectively, in a somewhat rear side (right side in FIG. 6 and FIG. 7) of the center part of the connector front-rear-extending-direction (left-right direction of FIG. 6 and FIG. 7). The above described movable beams 12*a* and 13*a* are integrally coupled to upper end parts of the coupling pillar parts 12*c* and 13*c* so as to extend in the connector front-rear direction (left-right direction of FIG. 6 and FIG. 7). The movable contact beams 12*a* and 13*a* are configured to be elastically deformed while the vicinities of the coupling pillar parts 12*c* and 13*c* are serving as centers thereof so that the movable contact beams 12*a* and 13*a* have elastic flexibility with respect to the fixed contact beams 12*b* and 13*b*. These movable contact beams 12*a* and 13*a* are elastically deformed within the extending plane including the paper planes of FIG. 6 and FIG. 7, and the extending-direction both end parts of the movable contact beams 12*a* and 13*a* are configured to be elastically displaced in the top-bottom direction of the illustration.

Furthermore, the front-end parts (left-end-side parts in FIG. 6 and FIG. 7) of the above described movable contact beams 12*a* and 13*a* are provided with terminal-contact convex parts 12*a*1 and 13*a*1 as contact parts to be connected to the electrically conductive paths consisting of either electrically conductive paths F2 (see FIG. 17) for signal transmission or shielding formed on the upper-surface side of the illustration of the signal transmission medium (for example, FPC or FFC) so that the convex parts form projecting shapes downward in the illustration. In addition, the signal transmission medium F is configured to be sandwiched between the terminal-contact convex parts 12*a*1 and 13*a*1 provided on the movable contact beams 12*a* and 13*a* and the fixed contact beams 12*b* and 13*b*, which are disposed so as to face the positions immediately therebelow.

Herein, corresponding to the terminal-contact convex parts 12*a*1 and 13*a*1 of the above described movable contact beams 12*a* and 13*a*, the side of the fixed contact beams 12*b* and 13*b* can be also provided with terminal-contact convex parts to be connected to either electrically conductive paths (illustration omitted) for signal transmission or shielding formed on the lower surface side in the illustration of the signal transmission medium (for example, FPC or FFC) so that the convex parts form projecting shapes upward in the illustration. The terminal-contact convex parts can be disposed so that the positions thereof are mutually shifted to the connector front side (left side in the illustration) or the connector rear side (right side in the illustration). Furthermore, the fixed contact beams 12*b* and 13*b* in the present embodiment are retained so as to be basically in the immobile state. However, in order to, for example, stabilize the contact pressure with the signal transmission medium (for example, FPC or FFC) F, for example, the front-end parts of the fixed contact beams 12*b* and 13*b* can be configured to be formed so as to be slightly lifted up from the bottom wall surface of the insulating housing 11 and be elastically displaceable.

At the connector front-end-side part (left-end-side part in FIG. 6) of the fixed contact beam 12 and at the connector rear-end-side part (right-end-side part in FIG. 7) of the fixed contact beam 13*b* like this, board-joining terminal parts 12*b*1 and 13*b*1 solder-connected to the electrically conductive paths (illustration omitted) formed on the printed wiring board described above are formed so as to establish electrical connections with respect to the printed wiring board via the board-joining terminal parts 12*b*1 and 13*b*1.

Furthermore, at connector rear-end parts of the fixed contact beams 12*b* and 13*b* and the movable contact beams 12*a* and 13*a*, a turning shaft 14*a* integrally provided with the actuator (connection operating means) 14 as described later is rotatably retained so as to be sandwiched in the part between both of the contact beams 12 and 13. More specifically, the upper edges of the connector rear-end parts of the fixed contact beams 12*b* and 13*b* are formed so as to form flat surfaces extending approximately horizontally, and the turning shaft 14*a* of the actuator 14 is disposed on the rear-end-side upper edge parts of the fixed contact beams 12*b* and 13*b* consisting of the flat surfaces so that the turning shaft 14*a* rotatably and slidably contacts the rear-end-side upper edge parts from the upper side.

On the other hand, at the lower edges of the movable contact beams 12*a* and 13*a*, cam action parts 12*a*2 and 13*a*2 projecting so as to form approximately chevron shapes toward the lower side in a lateral view are provided in the connector rear-end parts thereof, respectively. The turning shaft 14*a* of the above described actuator 14 is rotatably disposed in the part between the curved edge parts in the connector front side (left side in FIG. 6 and FIG. 7), which are owned by the cam action parts 12*a*2 and 13*a*2, and the parts of the curved edge parts of the cam action parts 12*a*2 and 13*a*2, which are continued to the lower edges of the movable contact beams 12*a* and 13*a*.

The cam action parts 12*a*2 and 13*a*2 provided in the movable contact beams 12*a* and 13*a* in this manner are configured to rotatably support the turning shaft 14*a* of the actuator (connection operating means) 14. Since the cam action parts 12*a*2 and 13*a*2 are provided, the turning shaft 14*a* of the actuator 14 is retained without falling toward the connector rear side and is slidable in the direction toward the connector front side. In other words, the turning shaft 14*a* of the actuator 14 is movable by sliding with respect to the lower edges of the movable contact beams 12*a* and 13*a* and the upper edges of the fixed contact beams 12*b* and 13*b* so that the entire actuator 14 is configured to be movable toward the connector front side. This point will be explained later in detail.

Herein, the axial-direction both end parts of the turning shaft 14*a* of the actuator (connection operating means) 14 are supported by bearing parts (illustration omitted) provided on the insulating housing 11 so that the turning shaft 14*a* is rotatable and reciprocable in the connector front-rear direction. By virtue of this, the actuator 14 is configured so that the actuator 14 is turned so as to be pushed down toward the connector rear side from an "initial position" (see FIG. 1 to FIG. 9) at which the actuator 14 is standing upward from the insulating housing 11 to a "tilted-down position" (see FIG. 10 and FIG. 11) extending approximately horizontally along the insulating housing 11 and that, when the actuator 14 turned to reach the "tilted-down position" is pushed in toward the connector front side (left side in FIG. 6 and FIG. 7), the actuator 14 is slid to a later-described "pushed-in action position".

Then, when the operation of pushing in the actuator (connection operating means) 14 from the "tilted-down position" toward the connector front side to the "pushed-in action position" in the above described manner, the movable contact beams 12*a* and 13*a* are elastically displaced so that the signal transmission medium (for example, FPC or FFC) is sandwiched between the movable contact beams 12*a* and 13*a* and the fixed contact beams 12*b* and 13*b*. This point will be explained later in detail.

[About Lock Member]

On the other hand, a pair of lock members 15, 15, which prevents removal of the signal transmission medium (for example, FPC or FFC) F inserted in the insulating housing 11, are attached to connector-longitudinal-direction both end parts of the insulating housing 11, in other words, both-side outer parts of the above described electrically-conductive contacts 12 and 13 so that the lock members 15 are pushed in from the connector front-end side toward the rear side.

Each of these lock members 15 also has a movable lock beam and a fixed lock beam (illustration omitted) consisting of a pair of slender beam members extending along the inserting direction (rightward direction in FIG. 6 and FIG. 7) of the signal transmission medium F. The movable lock beams and the fixed lock beams constituting the lock members 15 are disposed at connector-longitudinal-direction both-side parts of the medium housing passage 11*b* of the insulating housing 11 in a state in which the beams are opposed to each other with appropriate intervals therebetween in the top-bottom direction, and the beams are disposed so as to slenderly extend in the connector front-rear direction (left-right direction in FIG. 6 and FIG. 7). Latch lock claws to be mated with the signal transmission medium F are provided at connector front-end parts of the movable lock beams.

Figure 17:
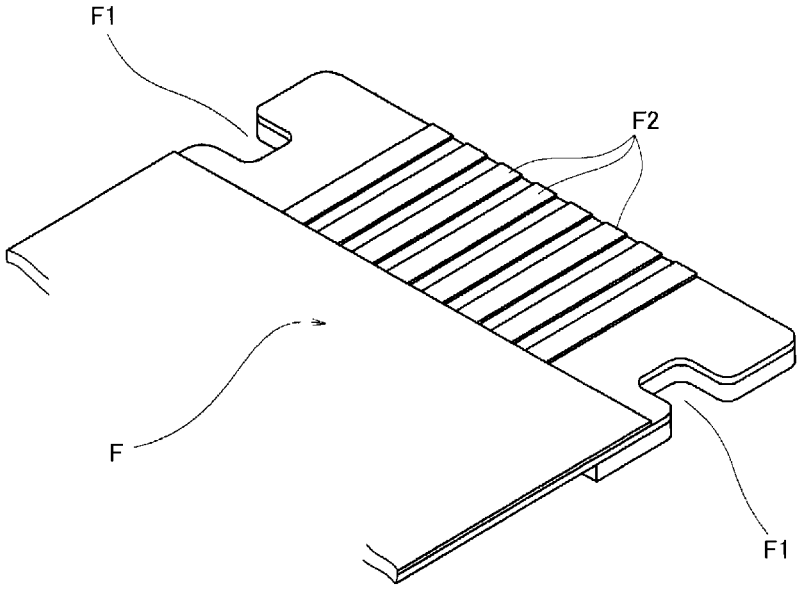
FIG. 17 is an external perspective-view explanatory drawing showing an example of the signal transmission medium (for example, FPC or FFC) connected to the electrical connector according to the present invention.
Figure 18:
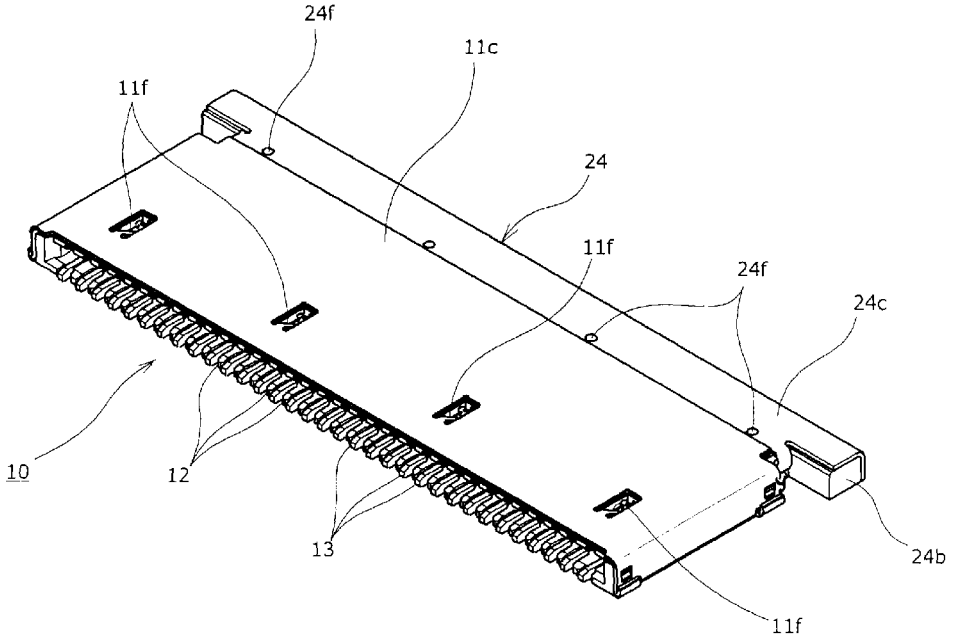
FIG. 18 is an external-perspective-view explanatory drawing showing, from the upper side of the connector front surface side, a state in which an actuator is raised to an initial position in an electrical connector according to a second embodiment of the present invention.
Figure 19:
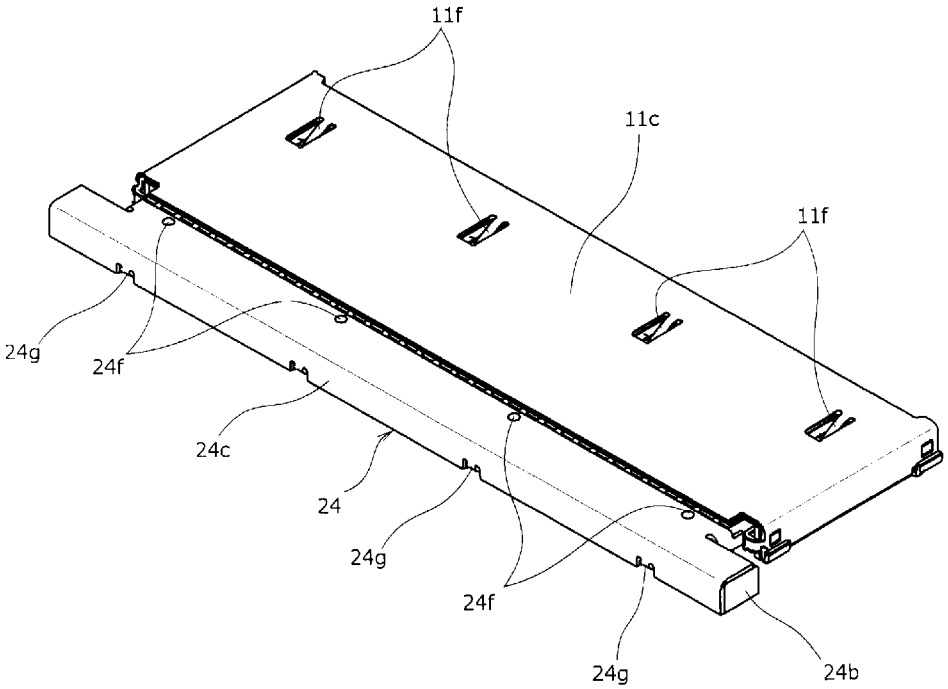
FIG. 19 is an external-perspective-view explanatory drawing showing, from the upper side of the connector back-surface side, the electrical connector, which is shown in FIG. 18.
Figure 20:
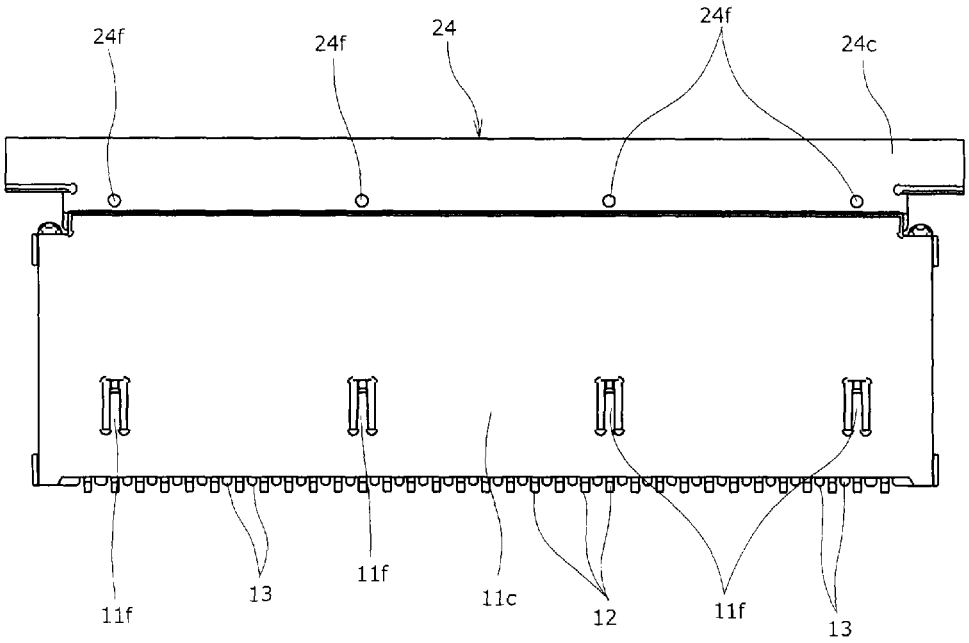
FIG. 20 is a plan explanatory drawing of the electrical connector, which is shown in FIG. 18 and FIG. 19.
Figure 21:
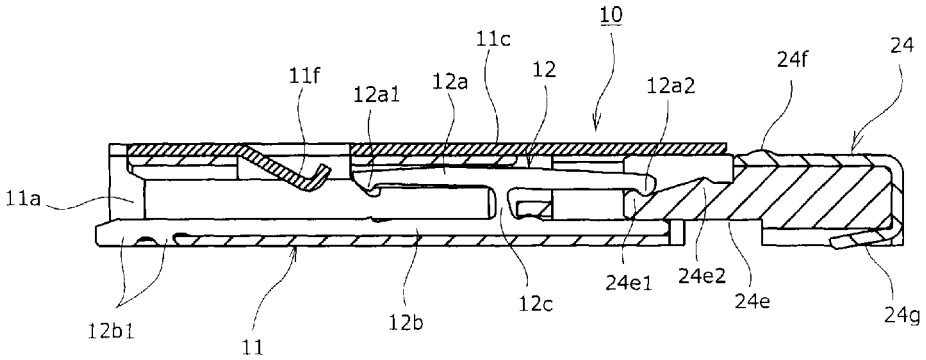
FIG. 21 is a FIG. 6 corresponding transverse cross-sectional explanatory drawing of a state in which the actuator of the electrical connector, which is shown in FIG. 18 to FIG. 20, is at the "initial position"
Figure 22:
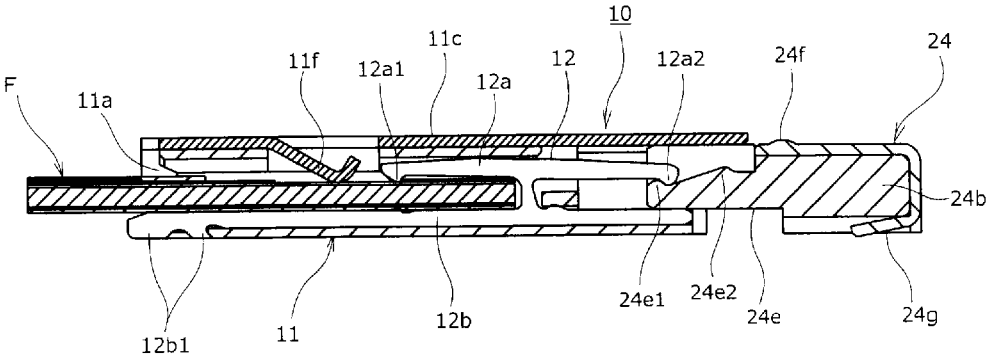
FIG. 22 is a FIG. 6 corresponding transverse cross-sectional explanatory drawing showing a state in which the terminal part of the signal transmission medium (for example, FPC or FFC) is inserted in the electrical connector, which is at the "initial position" shown in FIG. 21.
Figure 23:
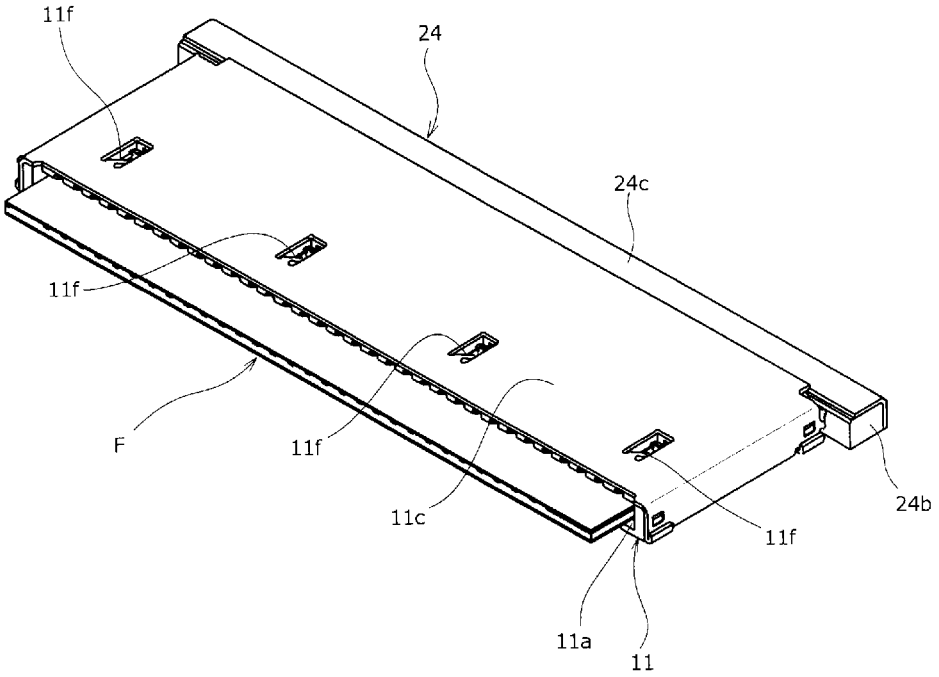
FIG. 23 is an external-perspective-view explanatory drawing showing, from the upper side of the front surface side, a state in which the actuator of the electrical connector, which is shown in FIG. 22, has been pushed to the "action position"
Figure 24:
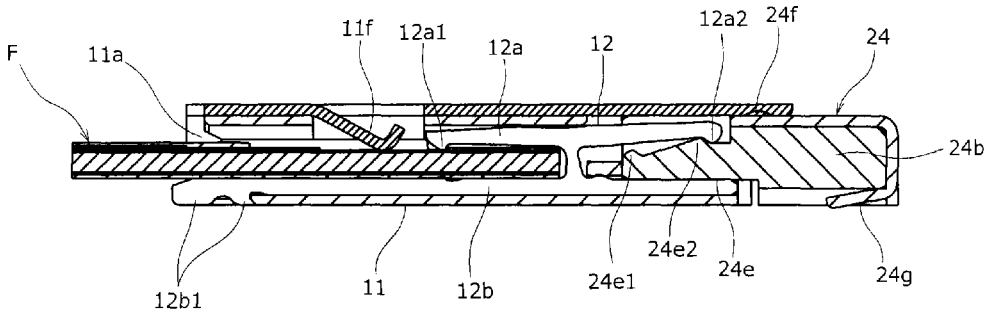
FIG. 24 is a FIG. 6 corresponding transverse cross-sectional explanatory drawing of a state in which the actuator of the electrical connector, which his shown in FIG. 22, has been pushed to the "action position"

On the other hand, the signal transmission medium (for example, FPC or FFC) F inserted in the inner space of the medium housing passage 11*b* provided in the insulating housing 11 in the above described manner is provided with, for example, the configuration as shown in FIG. 17, and the both edge parts thereof in the width direction thereof (connector longitudinal direction) are configured to be inserted in the part between the fixed lock beams and the movable lock beams of the above described lock members 15. Corresponding to the latch lock claws provided on the lock members 15, in a terminal part of the signal transmission medium F, engagement positioning parts F1, F1 consisting of cutout-shaped recessed parts are formed at width-direction (connector longitudinal direction) both-side edge parts of the signal transmission medium F.

Figure 10:
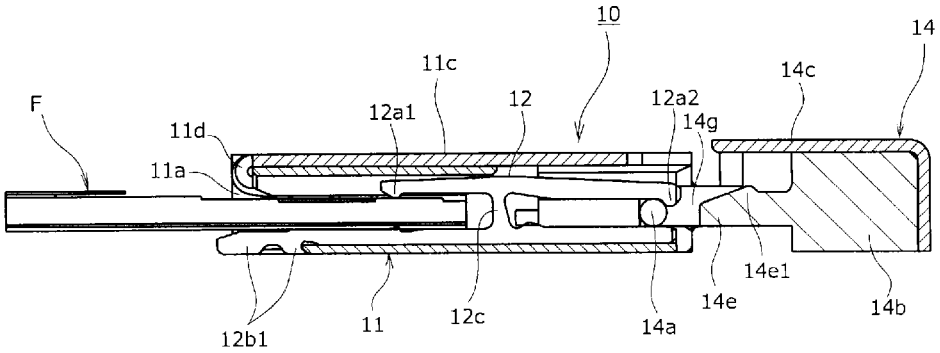
FIG. 10 is a FIG. 6 corresponding transverse cross-sectional explanatory drawing of a state in which the actuator of the electrical connector shown in FIG. 8 is pushed down to a "tilted-down position"
Figure 11:
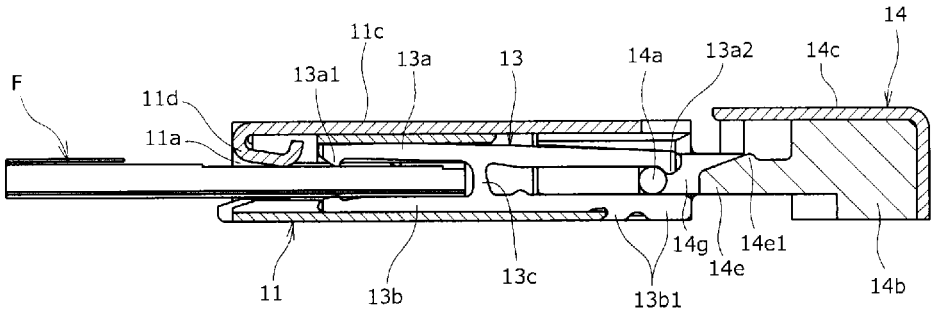
FIG. 11 is a FIG. 7 corresponding transverse cross-sectional explanatory drawing of a state in which the actuator of the electrical connector shown in FIG. 9 is pushed down to the "tilted-down position"
Figure 12:
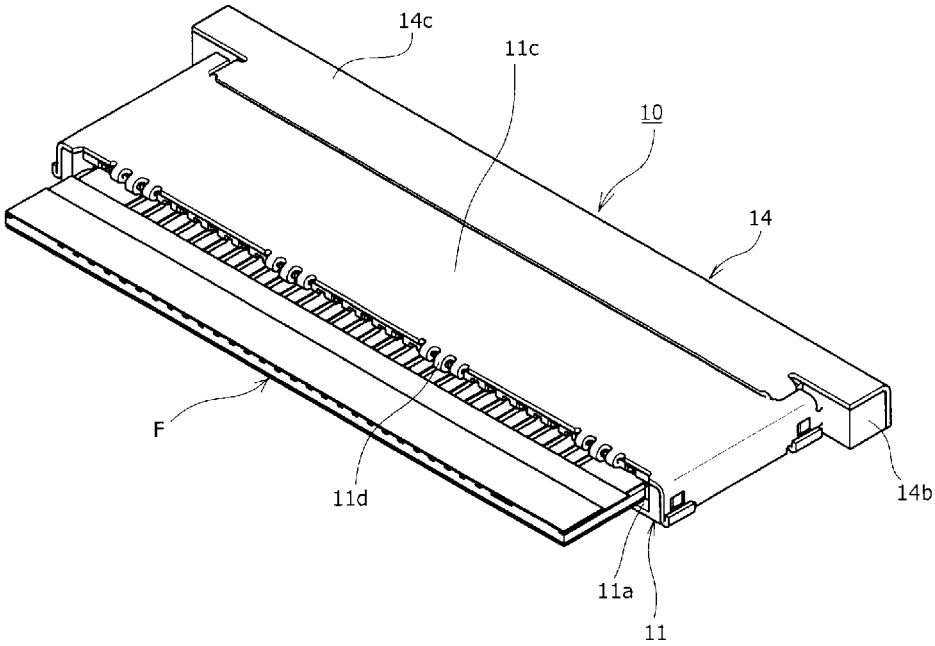
FIG. 12 is an external-perspective-view explanatory drawing showing, from the upper side of the connector front side, a state in which the actuator of the electrical connector shown in FIG. 10 has been pushed to an "action position"
Figure 13:
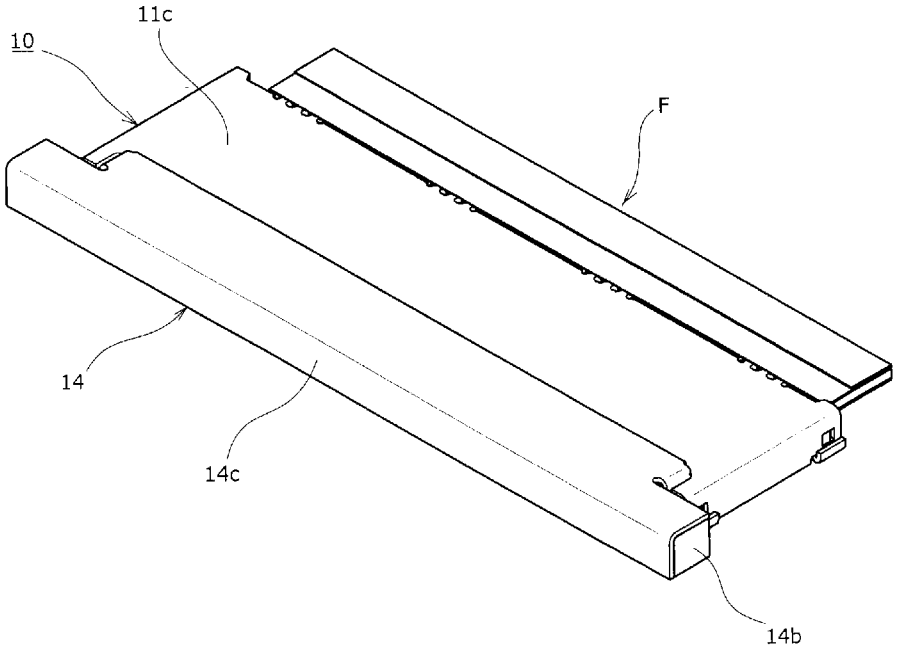
FIG. 13 is an external-perspective-view explanatory drawing showing the electrical connector, which is shown in FIG. 12, from the upper side of the connector back surface side.
Figure 14:
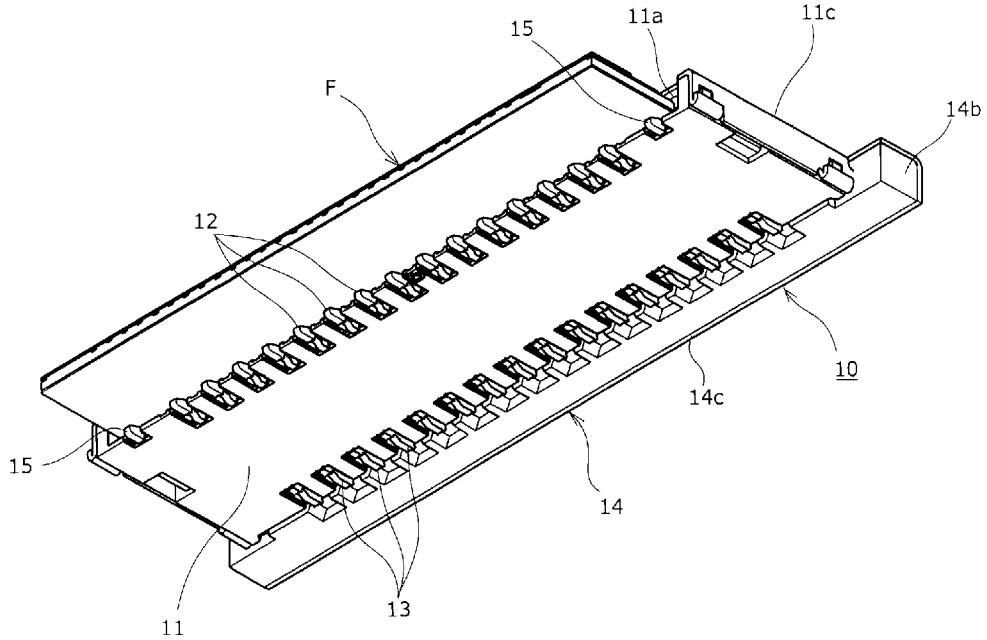
FIG. 14 is an external-perspective-view explanatory drawing showing the electrical connector, which is shown in FIG. 12 and FIG. 13, from the lower side of the connector front side.
Figure 15:
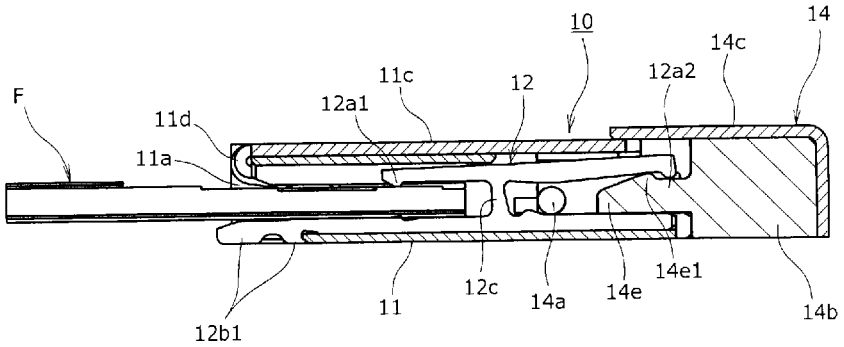
FIG. 15 is a FIG. 6 corresponding transverse cross-sectional explanatory drawing of a state in which the actuator of the electrical connector shown in FIG. 10 has been pushed to the "action position"
Figure 16:
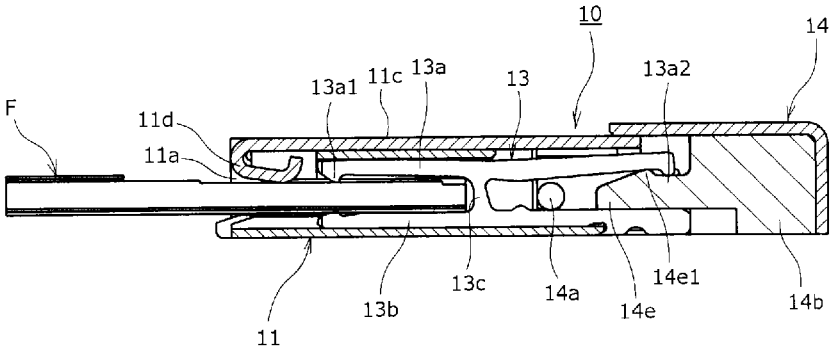
FIG. 16 is a FIG. 7 corresponding transverse cross-sectional explanatory drawing of a state in which the actuator of the electrical connector, which is shown in FIG. 11, has been pushed to the "action position"

A positional relation is set so that, when the signal transmission medium (for example, FPC or FFC) is pushed in toward the connector depth side (rightward direction in FIG. 6 and FIG. 7) and an inserting-direction distal edge part of the signal transmission medium F abuts and is stopped by the coupling pillar parts of the lock members 15, the engagement positioning parts F1 provided on the signal transmission medium F are disposed immediately below the latch lock claws provided on the lock members 15. When an operation of pushing in the actuator 14, which has been turned from the abutting/stopped state of the signal transmission medium F to the "tilted-down position" as shown in FIG. 10 and FIG. 11, to the "pushed-in action position" in the connector front side as shown in FIG. 12 to FIG. 16 is carried out, the latch lock claws of the lock members are moved down and become a state that the latch lock claws are engaged with the engagement positioning parts F1 of the signal transmission medium F (lock state), thereby preventing removal of the signal transmission medium F.

[About Actuator]

The actuator 14 serving as the above described connection operating means is provided with a turning-operation frame body 14*b*, which is slenderly formed of an insulating material, and the actuator shell (shield shell) 14*c*, which is attached so as to cover part of the outer surface of the turning-operation frame body 14*b*. At a proximal part of the turning-operation frame body 14*b* is provided with the turning shaft 14*a*, which is extending in the connector longitudinal direction in the above described manner. The turning shaft 14*a* is attached so as to be turnable along the connector-rear-side edge part (right end part in FIG. 6 and FIG. 7) of the insulating housing 11. Moreover, turning arms 14*g* consisting of narrow plate-shaped members are extending from the turning shaft 14*a* so as to form comb-tooth shapes toward the turning-radius outer side of the turning shaft 14*a*. The turning-operation frame body 14*b* consisting of the above described plate-shaped member is configured to be integrally coupled to extending-direction (rotating-radius outward direction) distal end parts of the turning arms 14*g*.

More specifically, the above described turning-operation frame body 14*b* is formed of a plate-shaped member slenderly extending along the axial direction (connector longitudinal direction) of the turning shaft 14*a*, and the plurality of turning arms 14*g*, 14*g*, and so on are disposed between an inner-side end face of the turning-operation frame body 14*b*, in other words, the end face thereof facing the side of the insulating housing 11 and the turning shaft 14*a* so that the turning arms are juxtaposed with predetermined intervals therebetween in the connector longitudinal direction. Each of the turning arms 14*g* is disposed in the part between the above described electrically-conductive contacts 12 and 13; and, at the parts each of which is between the pair of turning arms 14*g* and 14*g* mutually adjacent in the connector longitudinal direction, in other words, at the positions corresponding to the electrically-conductive contacts 12 and 13, a plurality of slits 14*d* for avoiding interference with both of the electrically-conductive contacts 12 and 13 are formed so as to form comb-tooth shapes at equal intervals.

Since the turning arms 14*g* and the slits 14*d* are provided so as to form comb-tooth shapes in this manner, the actuator (connection operating means) 14 is configured to be subjected to a turning operation without causing interference particularly with respect to the movable contact beams 12*a* and 13*a* of the electrically-contacts 12 and 13 and be subjected to the turning operation from the "initial position" in the state in which the actuator is provided upright toward the approximately perpendicular upper side as shown in FIG. 1 to FIG. 9 to the "tilted-down position" in which the actuator has been pushed down toward the connector rear side (rightward side of illustration) as shown in FIG. 10 and FIG. 11.

Moreover, each of the silts 14*d*, which is provided in the comb-tooth shape in the turning-operation frame body 14*b* of the actuator (connection operation means) 14 like this, is opened toward the side of the above described insulating housing 11 and is extending from the opening toward the turning-radius-direction outer side of the turning-operation frame body 14*b*, and a hook-shaped projecting part 14*e* is provided on a depth-side wall surface, which forms the interior space of the slit 14*d*. This hook-shaped projecting part 14*e* is formed of a plate-shaped member, which is extending in a cantilever shape so as to approach the turning shaft 14*a* serving as the turning center of the turning-operation frame body 14*e* from the depth-side wall surface of the slit 14*d* as described above. A pressing cam part 14*e*1 is formed at the extending side of the hook-shaped projecting part 14*e*, in other words, at a distal end part thereof in the inner side of the turning-radius direction of the turning-operation frame body 14*b*.

Herein, there is a disposition relation that, in a state in which the actuator (connection operating means) 14 is positioned at the "tilted-down position" at which the actuator has been pushed down to the connector rear side (rightward side of illustration) as shown in FIG. 10 and FIG. 11, the above described hook-shaped projecting part 14*e* faces the rear end parts of the movable contact beam 12*a* or 13*a* and the fixed contact beam 12*b* or 13*b* from the connector rear side. More specifically, the pressing cam part 14*e*1, which is provided at the extending-side distal end part of the hook-shaped projecting part 14*e*, is in a disposition relation that the pressing cam part 14*e*1 is opposed to the cam action part 12*a*2 or 13*a*2 provided at the rear end part of the movable contact beam 12*a* or 13*a* so that they are somewhat separated from each other in the connector front-rear direction (horizontal direction).

Then, when the hook-shaped projecting part 14*e* is moved forward as a result of applying operating force so as to slide the entire actuator (connection operating means) 14 toward the connector front side in the separated opposing state of the pressing cam part 14*e*1 with respect to the cam action part 12*a*2 or 13*a*2 in the above described manner, the inclined surface constituting the pressing cam part 14*e*1 of the hook-shaped projecting part 14*e* abuts the inclined surface constituting the cam action part 12*a*2 or 13*a*2 of the movable contact beam 12*a* or 13*a*. Then, the connector rear-end-side part of the movable contact beam 12*a* or 13*a* is displaced so as to be lifted up to the upper side by upward component force generated at the inclined surface of the cam action part 12*a*2 or 13*a*2, and the terminal-contact convex part 12*a*1 or 13*a*1 provided in the connector front-end side is configured to be pushed downward along with that.

More specifically, in the state in which the actuator (connection operating means) 14 is at the "initial position" (see FIG. 1 to FIG. 9), the signal transmission medium (for example, FPC or FFC) F is inserted into the medium housing passage 11*b* through the front-side insertion opening 11*a* of the insulating housing 11. Then, an operation of tilting down the actuator 14 toward the connector rear side is carried out to turn the actuator 14 to the "tilted-down position" at which the actuator is in an approximately horizontal state (see FIG. 10 and FIG. 11). Then, push-in operating force toward the connector front side is applied to the actuator 14, which is in such a horizontal state, and the actuator 14 is slid toward the connector front side to the "pushed-in action position", which is a final position. As a result, the movable contact beams 12*a* and 13*a* of the electrically-conductive contacts 12 and 13 are configured to be elastically deformed in the above described manner to maintain the terminal-contact convex parts 12*a*1 and 13*a*1 of the above described movable contact beams 12*a* and 13*a* in a state in which the convex parts are in pressure-contact with either the electrically conductive paths F2 (see FIG. 17) for signal transmission or grounding formed on the surface of the signal transmission medium (for example, FPC or FFC) F; and, as a result, electrical connections with the printed wiring board are established.

The actuator shell (shield shell) 14*c* covering the outer surface of the turning-operation frame body 14*b* of the above described actuator (connection operating means) 14 is formed of an electrically-conductive metal plate-shaped member. In the state in which the actuator 14 has been turned to the "tilted-down position" (see FIG. 10 and FIG. 11), the actuator shell 14*c* is attached so as to cover the outer surface corresponding to a connector rear-end face from the upper surface of the turning-operation frame body 14*b*.

At the above described "tilted-down position", an inner-side edge part thereof by which the actuator shell (shield shell) 14*c* faces the side of the insulating housing 11 is configured to be disposed so as to form a predetermined gap in the connector front-rear direction with respect to the rear edge part of the housing shell (shield shell) 11*c* of the above described insulating housing 11. Then, when the actuator 14 is slid to the above described final "pushed-in action position", the radius-direction inner edge part of the actuator shell 14*c* is brought into an electrically contacted state so as to be overlapped with the rear edge part of the housing shell 11*c* from the upper side.

Furthermore, in inner-side edge parts of the above described actuator shell (shield shell) 14*c*, lateral-end ground contact pieces 14*f*, 14*f*, which are bent downward approximately at right angle, are formed at connector-longitudinal-direction both side parts thereof. The lateral-end ground contact pieces 14*f* are bent so as to extend to the lower side at the "tilted-down position". More specifically, there is a relation that, when the actuator 14 is moved so as to be slid to the above described final "pushed-in action position", the lateral-end ground contact pieces 14*f*, 14*f* of the actuator shell 14*c* are disposed to electrically contact the lateral-end ground contact pieces 11*e*, 11*e*, which are provided on the housing shell 11*c* of the insulating housing 11, from the connector inner side (connector center side).

According to the present embodiment having such a configuration, when the actuator 14, which has been turned from the "initial position" to the "tilted-down position", is slid toward the connector front side to the "pushed-in action position", which is the final position, the operation of electrically connecting the electrically-conductive contacts 12 and 13 to the signal transmission medium (for example, FPC or FFC) F is completed. At this point of time, the actuator shell (shield shell) 14*c* attached to the actuator 14 is in a state in which the actuator shell 14*c* is electrically contacting the housing shell (shield shell) 11*c*, which is attached to the insulating housing 11, so as to be overlapped therewith from the upper side. As a result, the transmission paths from the signal transmission medium F to the printed wiring board through the electrically-conductive contacts 12 and 13 are continuously covered with the housing shell 11*c* and the actuator shell 14*c*, and good shielding performance is obtained.

Particularly, in the present embodiment, both of the shield shells 11*c* and 14*c* covering the insulating housing 11 and the actuator 14 are configured to be partially overlapped with each other in the state in which the actuator 14 has been pushed in toward the side of the insulating housing 11 in the above described manner. Therefore, the electromagnetic-wave shutoff action by both of the shield shells 11*e* and 14*c* are further improved.

Figure 25:
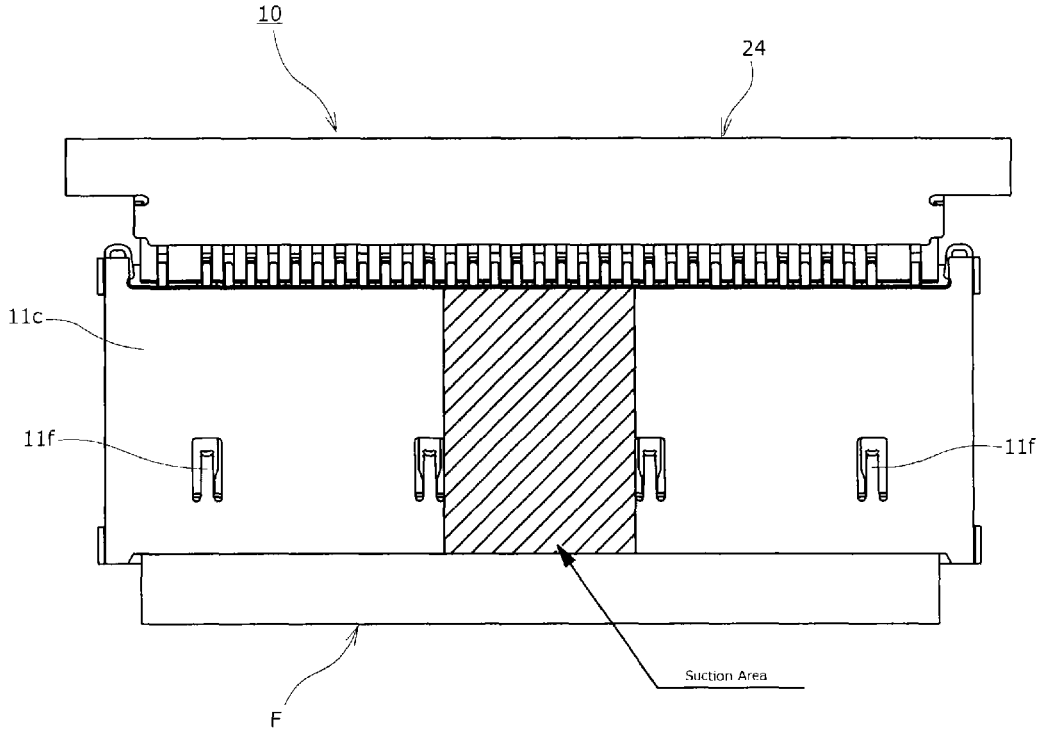
FIG. 25 is a plan explanatory drawing showing an example of a suction area.

Furthermore, in an assembly process of a receptacle connector 10 according to the present embodiment, if the receptacle connector 10 is suctioned by using a predetermined jig from the upper side, with respect to the housing shell 11*c* covering the upper surface of the insulating housing 11, the suction by the jig can be directly carried out, for example, with respect to a hatched region (suction area) of FIG. 25 showing a second embodiment of the present invention. As a result, good assembly performance can be obtained.

Furthermore, in the present embodiment, in a state in which the actuator 14 is pushed in toward the side of the insulating housing 11 in the shield shell 14*c* covering the actuator 14, the lateral-end ground contact pieces 11*e*, 11*e* serving as the ground members, which contact the electrically conductive paths on the printed wiring board; therefore, ground characteristics are improved.

[About Second Embodiment]

On the other hand, an actuator 24 employed in a second embodiment according to FIG. 18 to FIG. 24 in which the same constituent members as those of the above described first embodiment are denoted by the same symbols is configured to carry out a sliding operation instead of the turning operation like the above described first embodiment. More specifically, the actuator 24 is configured to be slid from an "initial position", at which the actuator is disposed so as to be separated from the rear edge part of the insulating housing 11 toward the connector rear side, to a "pushed-in action position", at which the actuator has been pushed in to the connector front side.

In the below explanations, the explanations of the configurations similar to those of the above described first embodiment are omitted, and different configurations will be mainly explained.

More specifically, a hook-shaped projecting part 24*e* provided at a slide-operation frame body 24*b* of the actuator 24 of the present embodiment so as to project toward the connector front side (leftward direction of FIG. 21 and FIG. 22) is extending so as to enter the inner side of the insulating housing 11. In the state of the "initial position" at which the hook-shaped projecting part 24*e* has been pulled out to the connector rear side, an extending-side distal end part of the hook-shaped projecting part 24*e*, in other words, a removal-preventing projecting part 24*e*1 provided in the part (inner end part) extending to the inner side of the insulating housing 11 is configured to enter the part between the movable contact beam 12*a* or 13*a* and the fixed contact beam 12*b* or 13*b*. More specifically, there is a disposition relation that the removal-preventing projecting part 24*e*1 of the above described hook-shaped projecting part 24*e* is contacting the cam action part 12*a*2 or 13*a*2, which is provided in the rear end part of the movable contact beam 12*a* or 13*a*, from the connector front side, thereby retaining the actuator so that the actuator 24 does not fall to the connector rear side.

In the hook-shaped projecting part 24*e* at this point, a chevron-shaped pressing cam part 24*e*2, which is projecting toward the upper side, is formed at the part from the above described removal-preventing projecting part 24*e*1 to the connector rear side. Then, when the entire actuator 14 at the "initial position" is subjected to a movement operation so that the actuator slides toward the connector front side, the inclined surface of the pressing cam part 24*e*1 of the above-described hook-shaped projecting part 24*e* abuts the inclined surface of the cam action part 12*a*2 or 13*a*2 of the movable contact beam 12*a* or 13*a* from the rear side, the connector rear-end-side part of the movable contact beam 12*a* or 13*a* is displaced so as to be lifted up to the upper side by upward component force generated at the inclined surface of the cam action part 12*a*2 or 13*a*2, and the terminal-contact convex part 12*a*1 or 13*a*1 provided in the connector front-end side is configured to be pushed downward along with that.

More specifically, in the state in which the actuator 24 is at the "initial position" (see FIG. 21 to FIG. 22), the signal transmission medium (for example, FPC or FFC) F is inserted into the medium housing passage 11*b* through the front-side insertion opening 11*a* of the insulating housing 11. Then, when push-in operating force toward the connector front side is applied to the actuator 24, the actuator 24 is slid toward the connector front side to the "pushed-in action position" serving as the final position. As a result, the movable contact beams 12*a* and 13*a* of the electrically-conductive contacts 12 and 13 are configured to be elastically deformed in the above described manner to maintain the terminal-contact convex parts 12*a*1 and 13*a*1 of the above described movable contact beams 12*a* and 13*a* in a state in which the convex parts are in pressure-contact with either the electrically conductive paths (illustration omitted) for signal transmission or grounding formed on the surface of the signal transmission medium F; and, as a result, electrical connections with the printed wiring board are established.

Moreover, a plurality of upper-surface ground contact pieces 11*f* consisting of cantilever-shaped elastic members, which are cut to be lifted downward toward the medium housing passage 11*b*, are formed on the housing shell 11*c* attached to the insulating housing 11. The upper-surface ground contact pieces 11*f* are disposed so as to be ground-contacted to the upper surface of the signal transmission medium (for example, FPC or FFC) inserted in the medium housing passage 11*b*.

Furthermore, the actuator 24 of the present embodiment is also provided with an actuator shell 24*c* so that part of the outer surface of the slide-operation frame body 24*b* is covered. In the state in which the actuator 24 is pulled out to the "initial position", the connector-front-side edge part of the actuator shell 24*c* is disposed at a position separated from the rear edge part of the housing shell 11*c*, which is attached to the above described insulating housing 11, toward the connector rear side. Then, when the actuator 24 is moved so as to slide toward the connector front side to the above described final "pushed-in action position", there is a positional relation that the front edge part of the actuator shell 24*c* abuts the rear edge part of the housing shell 11*c* from the lower side.

When the actuator shell 24*c* abuts the housing shell 11*c* in this manner, there is obtained a state in which the front edge part of the actuator shell 24*c* is in surface-contact with the rear edge part of the housing shell 11*c* so as to be overlapped therewith from the lower side. Herein, a plurality of pimples 24*f* consisting of small projections projecting upward are formed across a front edge part of the actuator shell 24*c*, and the pimples 24*f* are configured to reliably abut the housing shell 11*c* from the lower side.

Moreover, a plurality of lower-surface ground contact pieces 24*g* consisting of cantilever-shaped elastic members are formed across the lower wall part of the above described actuator shell 24*c*, in other words, the wall surface thereof facing a printed wiring board (illustration omitted). The lower-surface ground contact pieces 24*g* are disposed so as to be ground-connected with the electrically conductive paths formed on the printed wiring board.

Also in the second embodiment having such a configuration, actions/effects approximately similar to those of the above described first embodiment are obtained. Particularly, in an assembly process of a receptacle connector 10 according to the present embodiment, if the receptacle connector 10 is suctioned by using a predetermined jig from the upper side, the suction by the jig can be directly carried out, for example, with respect to a hatched region (suction area) of FIG. 25 of the housing shell 11*c* covering the upper surface of the insulating housing 11 with spatial allowance. As a result, good assembly performance can be obtained.

Figure 26:
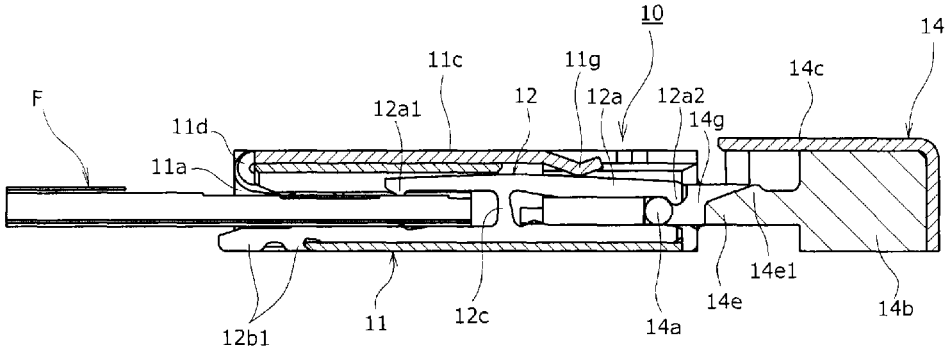
FIG. 26 is a FIG. 10 corresponding transverse cross-sectional explanatory drawing showing an embodiment in which an elastically-deformable ground member is provided on a housing shell (shield shell) in the electrical connector according to the first embodiment of the present invention.

On the other hand, in an embodiment shown in FIG. 26, an elastically-deformable contact spring member (ground member) 11*g* is formed by cutting and raising on an upper wall part of the housing shell (shield shell) 11*c* covering the insulating housing 11 of the above described first embodiment so as to be bulged toward the lower side. The contact spring member 11*g* has a ground contact part at an apex part of the bulging toward the lower side and is disposed so as to elastically contact the movable contact beam 12*a* of the electrically-conductive contact 12, which constitutes the ground member, from the upper side.

According to the embodiment having such a configuration, the electrical paths constituting a ground circuit are in a multi-point contact state, and ground resistance is correspondingly reduced.

Hereinabove, the invention accomplished by the present inventors has been explained in detail based on the embodiments. However, the present invention is not limited to the above described embodiments, and it goes without saying that various modifications can be made within a range not departing from the gist thereof.

For example, the above described embodiments employ a flexible printed circuit (FPC) and a flexible flat cable (FFC) as the signal transmission media to be fixed to the electrical connector. However, the present invention can be similarly applied also to the cases in which other signal transmission media, etc. are used.

The electrical connectors according to the above described embodiments use the electrically-conductive contacts having mutually different shapes. However, the present invention can be similarly applied also to an electrical connector using electrically-conductive contacts having identical shapes.

The present invention can be widely applied to various electrical connectors used in various electrical devices.

What is claimed is:

1. An electrical connector comprising:

an insulating housing having an interior in which an electrically-conductive contact member is disposed, and an actuator reciprocably attached to the insulating housing; and shield shells having electrically-conductive metal members respectively attached to the insulating housing and the actuator so as to cover at least part of outer surfaces of the insulating housing and the actuator, the electrical connector being configured so as to form a transmission path from a signal transmission medium to a printed wiring board through the electrically-conductive contact member by moving the actuator from an initial position to an action position and electrically connecting the signal transmission medium inserted in the insulating housing with the electrically-conductive contact member, the action position being set at an outer position from the insulating housing in a direction of inserting the signal transmission medium, wherein the actuator is configured to be turned from the initial position, at which the actuator is separated from the insulating housing in a direction along the printed wiring board and the actuator is raised from an upper surface of the insulating housing, to a tilted-down position, at which the actuator extends along the upper surface of the insulating housing, and the actuator is slid from the tilted-down position to the action position, at which the actuator contacts the insulating housing, wherein the actuator is provided with a turning-operation frame body formed of au insulating material, and a part of the outer surface of the turning-operation frame body is covered by an actuator shield shell, wherein the electrical connector has a disposition relation that, when the actuator is moved to the action position, an actuator-side shield shell and an insulating-housing-side shield shell contact each other so as to continuously cover the transmission path from the signal transmission medium to the printed wiring board through the electrically-conductive contact member, and the actuator-side shield shell covers an opening set at an end position of the insulating housing, the end position of the insulating housing being at an end opposite an end to insert the signal transmission medium, wherein a part of the turning-operation frame body formed of the insulating material is configured to abut the electrically-conductive contact member to make the electrically-conductive contact member deform and electrically connect with the signal transmission medium.

2. The electrical connector according to claim 1, wherein both of the shield shells covering the insulating housing and the actuator are configured to be partially overlapped with each other in a state of the actuator moved to the action position.

3. The electrical connector according to claim 1, wherein a ground member in contact with the shield shell covering the actuator in a state of the actuator moved to the action position is elastically deformably provided on the shield shell covering the insulating housing.

4. The electrical connector according to claim 1, wherein a ground member in contact with the signal transmission medium inserted in the insulating housing is elastically deformably provided on the shield shell covering the insulating housing.

5. The electrical connector according to claim 1, wherein a ground member in contact with the shield shell covering, the insulating housing in a state of the actuator moved to the action position is elastically deformably provided on the shield shell coveting the actuator.

6. The electrical connector according to claim 1, wherein a ground member in contact with the electrically-conductive contact member is elastically deformably provided on the shield shell coveting the insulating housing.

* * * * *